United States Patent [19]

Hoover et al.

[11] Patent Number: 4,582,259

[45] Date of Patent: Apr. 15, 1986

[54] WASH ARM AND METHOD AND APPARATUS FOR FORMING THE SAME

[75] Inventors: Richard D. Hoover, Troy; William H. McMahon, Ludlow Falls, both of Ohio

[73] Assignee: Hobart Corporation, Troy, Ohio

[21] Appl. No.: 649,586

[22] Filed: Sep. 12, 1984

[51] Int. Cl.[4] ..... B05B 1/14; B21D 53/00; B21D 7/00

[52] U.S. Cl. ..... 239/559; 29/157 C; 29/DIG. 26; 72/316; 72/335; 72/367; 239/251; 239/567; 239/DIG. 1

[58] Field of Search ..... 29/157 C, DIG. 26; 72/316, 335, 367; 239/251, 559, 567, DIG. 1; 134/104, 172, 175, 176, 179, 198, 199

[56] References Cited

U.S. PATENT DOCUMENTS

| | | | |
|---|---|---|---|
| 528,144 | 10/1894 | Cadwell | 239/567 X |
| 978,597 | 12/1910 | Kennedy | 29/157 C |
| 1,410,312 | 3/1922 | Huffman | 239/567 X |
| 2,714,277 | 8/1955 | Shepard | 29/157 C |
| 2,744,429 | 5/1956 | Seely | 72/367 X |
| 2,905,393 | 9/1959 | Federighi et al. | 134/179 UX |
| 3,209,575 | 10/1965 | Woodward, Jr. et al. | 72/335 |
| 3,323,529 | 6/1967 | Geiger et al. | 134/104 |
| 3,430,861 | 3/1969 | Geiger et al. | 239/251 |

FOREIGN PATENT DOCUMENTS

| | | | |
|---|---|---|---|
| 108953 | 11/1939 | Australia | 239/251 |
| 835251 | 5/1960 | United Kingdom | 239/559 |

*Primary Examiner*—Howard N. Goldberg
*Assistant Examiner*—Ronald S. Wallace
*Attorney, Agent, or Firm*—Biebel, French & Nauman

[57] ABSTRACT

A method of forming a spray nozzle along a fluid conduit includes forming a hole into a length of tubing and then providing a countersink for the hole. A portion of the tubing is then depressed inwardly along an imaginary line along the tubing outer surface that is parallel to the central tube axis and that passes over the hole. An apparatus for carrying out the method is also disclosed.

18 Claims, 12 Drawing Figures

WASH ARM AND METHOD AND APPARATUS FOR FORMING THE SAME

BACKGROUND OF THE INVENTION

The present invention relates generally to the formation of spray nozzles along a fluid conduit, and more particularly, to a wash arm for a dishwashing machine and a method and apparatus for forming the same.

Virtually all dishwashers, whether commercial or domestic, operate by directing pressurized streams of heated washing liquid consisting of water and detergent against the ware to be washed. The heated water sanitizes the ware, while the pressurized streams strip soil particles from the ware. These streams typically emanate from a plurality of nozzles which are formed along one or more fluid conduits or wash arms. A pumping system directs water into the wash arm, and the water then exits through the nozzles for cleansing of the ware. In order to properly clean the ware, complete coverage is required.

A number of different nozzle constructions have been used in dishwashing machines, along with a range of methods for forming the nozzles. In general, such variety has been caused by the variety in types of dishwashing machines, in which different needs in terms of nozzle performance are typically present.

Several examples of wash arm and nozzle construction can be seen in U.S. Pat. No. 4,439,242 issued Mar. 27, 1984 to Hadden. One type of wash arm is shown for use in a commercial dishwasher designed to wash only a single rack of ware at any one time. Upper and lower wash arm assemblies are provided, each comprising a pair of fluid conduits extending in opposite directions from a central hub. Each conduit has several bosses formed along its length, directed generally toward the interior of the wash chamber. A slot is formed on each boss to extend in a direction parallel to the conduit. The bosses are formed to direct water from the slots in a somewhat rearward direction with respect to the desired direction of rotation of the arm about the central hub. Thus, the water pressure as the water emerges from each slot also causes rotation of the arms.

Most dishwashers recycle wash water, and it is therefore quite difficult if not impossible to prevent some soil or debris washed from the ware from being recirculated through the wash arms. Although the water is typically filtered, the filters are generally fairly coarse to avoid restriction of water flow. Because the bosses of the nozzle construction just described extend outwardly from the fluid flow path along the conduit interior, such debris tends to move into the bosses and remain there, since the debris is then sheltered from the primary flow path. To make certain that such debris does not clog the nozzle openings, the slots are made relatively large so that the debris can easily pass through each slot.

By forming large slots, the fan-shaped water stream emerging from each nozzle cannot be strictly defined. This is not a critical limitation, since the rotation of the wash arms insures adequate water coverage of the ware. However, the large quantity of water that must be pumped through such slots requires a high capacity, and hence more expensive, pumping system.

The Hadden patent also discloses a conveyor-type commercial dishwasher in a which a different wash arm construction is used. In such a machine, a plurality of arms are disposed above and below the conveyor path, extending generally laterally across each rack of dishes as it is moved through the machine. Because the arms are stationary, more precise direction of the water streams emerging from each nozzle is required to achieve adequate coverage. Accordingly, a fan-like structure is attached to the exterior surface of each conduit, with a slot formed through the conduit and opening into the interior of the structure.

Since the fan-like structures are used to direct the water streams instead of bosses, clogging of slots by debris is reduced, and slot size can be smaller. A lower-capacity pumping system can then be used. However, while this type of wash arm and nozzle construction provides for well-defined and accurately directed water streams, it represents a relatively expensive means of wash arm construction. The fan structures must be fabricated and then individually attached along each wash arm.

Another method for forming a wash arm, used in a domestic-type machine, is disclosed in U.S. Pat. No. 3,323,529 issued June 6, 1967 to Geiger et al. Each wash arm is formed from trough-like upper and lower half portions, which are subsequently attached by crimping along the side edges of the half portions to form the entire arm. Formed within one half portion of the arm are a series of spherical inward impressions, each having a slot defined therein through the portion. The impressions and slots define the nozzles along the wash arm, and are formed at the same time as the half portion is initially fabicated by stamping the halves from sheet material.

The inward impressions formed in the wash arms substantially solve the problem associated with outward bosses, in that soil particles do not collect around the nozzle area. However, the stamping procedure requires a significant investment in tooling, as does the machinery for crimping the halves to form the completed wash arm. This increases the cost of manufacturing for each dishwasher, and is a particularly significant problem for large commercial type dishwashing machines, such as those shown in the Hadden patent. Since relatively small numbers of such machines are manufactured, the relatively expensive tooling to form such wash arms repesents an economic drawback.

What is needed, therefore, is a relatively simple method for forming a fluid conduit having spray nozzles for use as a dishwasher wash arm. The method must be able to produce wash arms at relatively low cost and with a relatively small investment in tooling. A wash arm formed by such a method should tend to resist clogging of nozzle openings by soil particles, and should be capable of producing relatively well-defined and accurately positioned water streams. This will enable such an arm to be used in a variety of types of machines.

SUMMARY OF THE INVENTION

The present invention meets these needs by providing a method of forming spray nozzles along a fluid conduit, the conduit then being suitable for use within a dishwashing machine as a wash arm. The method includes as a first step the drilling of a hole into a length of tubing so that the hole defines an opening substantially radial to the central axis of the tubing. The hole is then countersunk to the bottom of the hole, whereby the opening is of a greater diameter on the outer surface of the tubing than on the inner surface. After deburring to remove any burrs created by the drilling operation, a portion of the tubing is then depressed inwardly along an imaginary line parallel to the central tube axis that extends along the outer surface of the tubing. In addition, the line passes over the hole, so that the depression and hole together form a spray nozzle that will direct a fairly narrow-width, fan-shaped water stream outwardly from the tubing when the tubing is pressurized with water.

More specifically, the method may include the drilling, countersinking and deburring of a hole, followed by supporting the tubing around substantially its entire outer surface. A wedge having a leading edge is positioned against the outer surface of the tubing along the line parallel to the central tube axis and over the hole. The wedge is directed towards the axis, and is then forced radially against the tubing, whereby the outer surface along the line is moved inwardly toward the central tube axis.

A plurality of holes may be formed along the tubing to provide a wash arm having a plurality of spray nozzles which provide overlapped fan-shaped sprays to form a continuous wall of water along the tubing. The holes are formed along the tubing in a substantially linear relationship parallel to the central tube axis. To acheive non-interference from adjacent sprays, the holes are formed in an alternately staggered fashion with respect to an imaginary line parallel to the central tube axis. Individual depressions are preferably formed for each hole, although a single depression might be formed along substantially the entire tubing. In any event, the depressions are formed along the line passing over the holes.

The present invention also provides an apparatus for forming a spray nozzle into a length of ductile tubing. The tubing is provided with a hole formed therethrough substantially radial to the central tube axis, countersunk so that the hole is of greater diameter on the outer surface than on the inner surface of the tubing. The apparatus includes means for releasably supporting the tubing around substantially the entire portion of its outer surface, and a wedge having a leading edge. The wedge is slidably carried within an opening through the supporting means so that the leading edge can be positioned against the outer surface of the tubing when held within the supporting means, and is disposed adjacent the outer surface to extend over each hole. Relative movement of the wedge with respect to the supporting means causes the wedge to depress inwardly the portion of the tubing adjacent the wedge.

Accordingly, it is an object of the present invention to provide a method and apparatus for forming a fluid conduit in which one or more spray nozzles are defined along its length; to provide such a conduit that is suitable for use as a wash arm in a dishwashing machine; to provide such a method that can be performed at relatively low cost with relatively little expenditure for tooling; to provide such a method in which the formed nozzles provide well-defined and accurately directed water sprays; to provide such a method in which adjacent spray nozzles may be relatively closely-spaced without interference between the sprays formed thereby; to provide such a method in which the formed nozzles resist clogging with debris circulated with water through the fluid conduit; and to provide such a method that produces wash arms capable of use within a variety of different dishwasher types.

Other objects and advantages of the present invention will be readily apparent from the following description, the accompanying drawings and the appended claims.

DETAILED DESCRIPTION OF THE PREFERRED EMBODIMENT

The method according to the present invention for forming a series of spray nozzles along a fluid conduit produces a wash arm that is suitable for use within a dishwashing machine. The completed wash arm can be used with several different types of such machines, and essentially is simply substituted for wash arms presently employed, whether they be stationary or rotatable. Specific examples of two typical dishwashing machines with which the wash arms can be used are found in U.S. Pat. No. 4,439,242, issued Mar. 27, 1984 to Hadden, which is hereby incorporated by reference. One such machine disclosed therein is a conveyor-type machine, where racks of ware to be washed are moved along a conveyor to various stations within the machine at which washing, rinsing, drying and the like are performed. A second type disclosed therein is a single rack machine, in which a single rack of ware is placed into the machine, with all of the washing steps being carried out at a single location. In addition, wash arms formed according to the present method could be used in a domestic, home-type dishwasher.

It should also be recognized that the present method may be used to form spray nozzles along a fluid conduit for uses other than in a dishwashing machine. In this regard, while the present invention is well suited for forming wash arms, the ultimate end use of the fluid conduit with spray nozzles formed by the present invention should in no way be taken to limit the scope of the present invention.

The method of the present invention is performed upon a length of cylindrical tubing, from which the fluid conduit and spray nozzles therein are formed. The tubing is of a ductile material and in the preferred embodiment, for use as a dishwasher wash arm, is stainless steel tubing having a diameter of 3.75 cm and a wall thickness of 0.125 cm. Of course, depending upon the end use for the fluid conduit, other dimensions may be more preferable, and the tubing may be formed from some other metallic or even non-metallic ductile material. In addition, the length of the tubing is entirely dependent upon its intended use.

Figure 1:
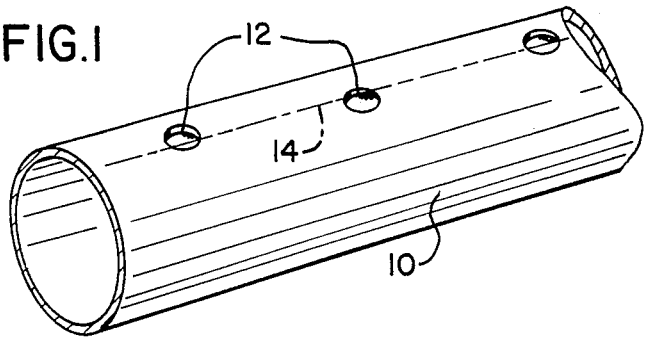
FIG. 1 is a perspective view of a portion of a length of tubing following an initial step of formation thereinto of spray nozzles according to the method of the present invention.

As shown in FIG. 1, the length of tubing 10 has a series of holes 12 formed, preferably by drilling, through the wall of tubing 10. Holes 12 are all drilled generally along an imaginary line 14 on the outer surface of tubing 10 that is parallel to the central axis of the tubing. For reasons that will be described in detail below, the holes may be drilled along line 14 in an alternating staggered fashion so as to be slightly off-center from line 14. The axis of each hole 12 extends radially toward the center of tubing 10, and in the preferred embodiment, each hole 12 is of a diameter of 0.625 cm. Further, adjacent holes are separated by 13.0 cm center-to-center.

Figure 2:
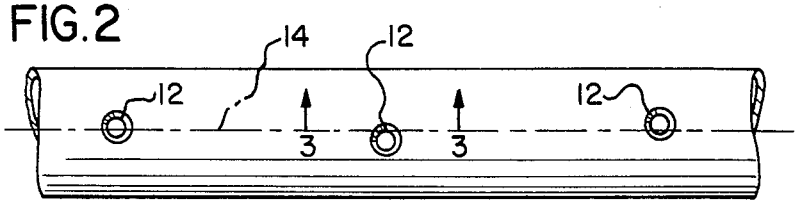
FIG. 2 is a plan view of the tubing of FIG. 1 following a next succeeding step of the method.
Figure 3:
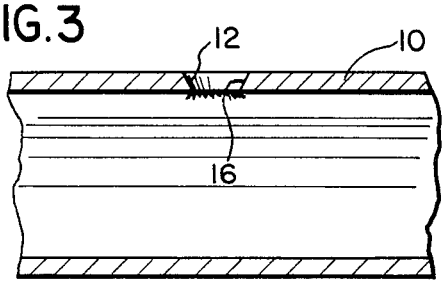
FIG. 3 is a view taken generally along line 3—3 of FIG. 2.

Following drilling, each hole 12 is countersunk to the bottom of the hole as shown in FIGS. 2 and 3. In the preferred embodiment, an approximately 82° countersink is provided. Thus, as shown in FIG. 3, each hole 12 includes a beveled side 16.

Drilling normally creates burrs on the inner edges of the holes 12 as shown in FIGS. 1 and 3. While countersinking often removes some of the burrs, any burrs remaining after countersinking should be removed by any standard deburring tool. If not removed, the burrs create the potential for catching soil when the completed tubing is subsequently used, possibly blocking passage of fluid.

Figure 4:
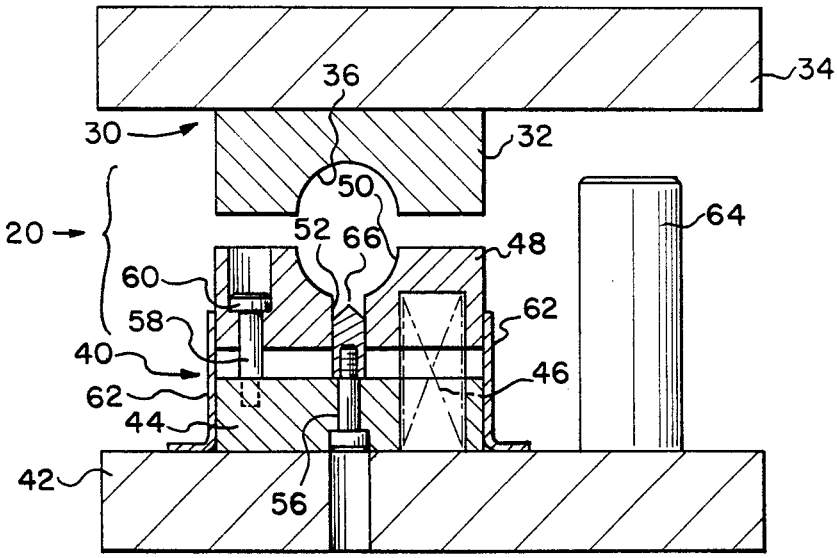
FIG. 4 is a sectional view of an apparatus for performing the remainder of the method on the tubing of FIG. 2.

The drilled, countersunk and deburred tubing is next placed within the forming apparatus 20 shown in FIG. 4. Apparatus 20 is mounted within a typical ram press, and includes punch tooling 30 having a punch 32 secured to an upper base 34. Upper base 34 is in turn connected to the press ram (not shown) so that punch tooling 30 can be moved up and down by the ram. Punch 32 is provided with a half-cylindrical trough 36 having a radius equal to the outer radius of tubing 10, and a length slightly less than tubing 10.

Die tooling 40 is carried on the press bed, and is supported by lower base 42. A bottom plate 44 is mounted to lower base 42 and includes a plurality of springs 46 (one shown; see also FIG. 7) carried in bottom plate 44 for supporting die 48.

Die 48 includes a half-cylindrical trough 50 formed therein having a radius equal to the outer radius of tubing 10. Thus, when die 48 and punch 32 are placed together, troughs 36 and 50 cooperate to form a cylindrical chamber of identical diameter to tubing 10.

An opening 52 is provided at the bottom of trough 50. A wedge 54 is carried within opening 52, secured to bottom plate 44 by a bolt 56. Additional bolts 58 (only one shown for clarity; see FIG. 7 for proper positioning) pass through openings in die 48 and are secured into bottom plate 44. The head 60 of each bolt 58 serves as an upward limit on movement of die 48 by springs 46. A pair of guide plates 62 are secured to either or both lower base 42 and bottom plate 44, to insure that any movement of die 48 with respect to bottom plate 44 is entirely within a vertical direction. Finally, a stop 64 is carried on lower base 42 to provide a limit to downward movement of punch tooling 30.

After holes 12 in tubing 10 have been drilled, countersunk and deburred, tubing 10 is placed into trough 50 of die 48. Tubing 10 is placed within trough 50 so that holes 12 are at the lowermost portion of tubing 10, and are positioned directly above leading edge 66 on wedge 54. Axial and circumferential location of the tubing is controlled by a positioning pin 70 as will be later described in connection with FIGS. 7 and 8.

Figure 5:
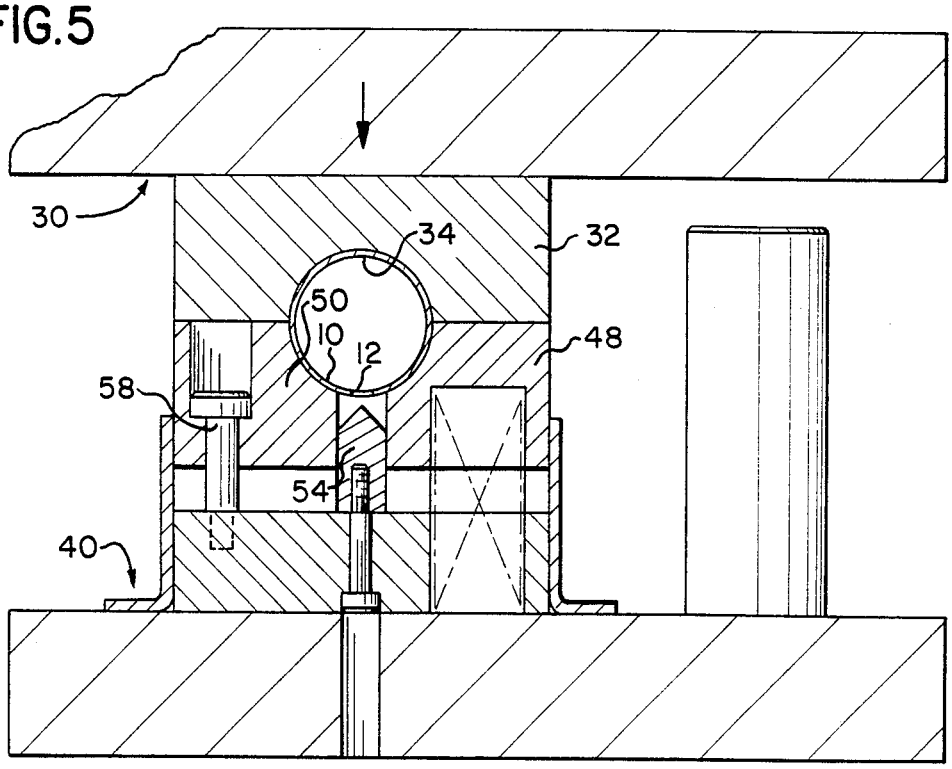
FIG. 5 is a view similar to FIG. 4, showing the tooling supporting the outer surface of the tubing.

As shown in FIG. 5, punch tooling 30 is lowered toward die tooling 40 until punch 32 contacts die 48. Tubing 10 is then securely held within troughs 36 and 50, so that the only unsupported portion on tubing 10 is that directly over wedge 54, including holes 12.

Figure 6:
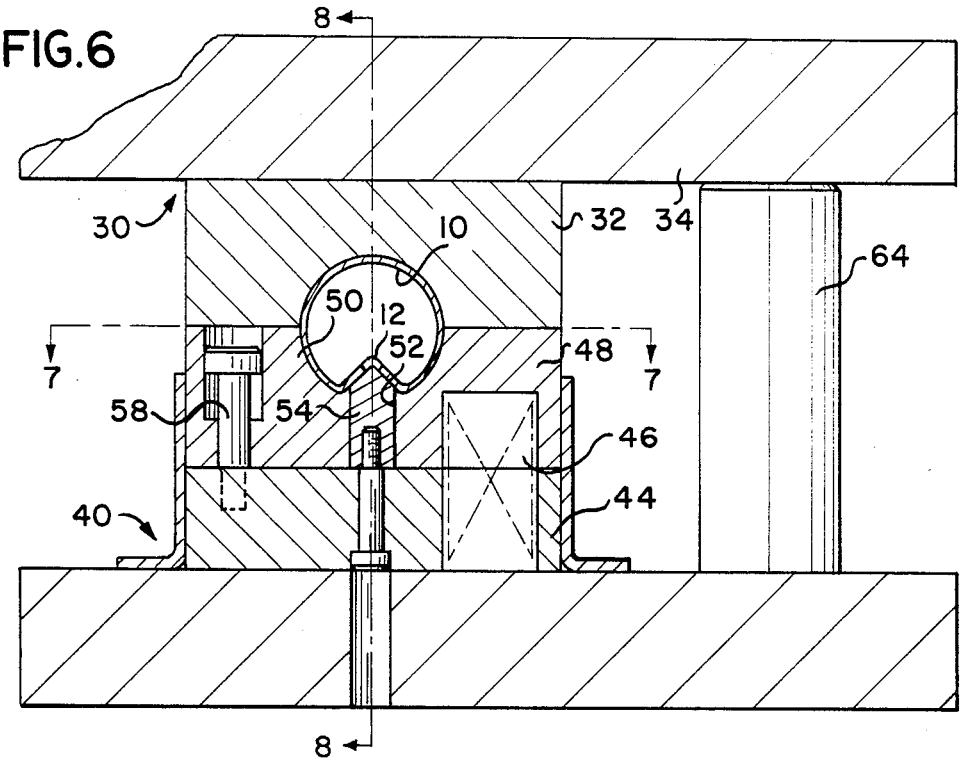
FIG. 6 is a view showing the tooling in its bottommost position, following complete formation of spray nozzles into the tubing.

As seen in FIG. 6, die tooling 30 continues to be moved downward, and punch 32, having contacted die 48, forces die 48 downwardly toward bottom plate 44. Since wedge 54 is secured against bottom plate 44, it moves through opening 52 in trough 50, emerging thereinto. Wedge 54 contacts tubing 10, and depresses the portion of tubing 10 adjacent wedge 54 inwardly. Thus, a depression is formed into tubing 10, with holes 12 positioned along the base of the depression. Because tubing 10 is fully supported elsewhere about its exterior, only that portion adjacent wedge 54 is deformed. No internal mandrel is required to support the inner surface of the deformed tubing.

Once punch tooling 30 has been lowered so that upper base 34 contacts stop 64, downward motion is halted and formation of tubing 10 is substantially completed. Punch tooling 30 is then raised, releasing die tooling 40, with die 48 being raised from bottom plate 44 by springs 46. The tooling 20 is then returned to its initial position shown in FIG. 4.

Figure 7:
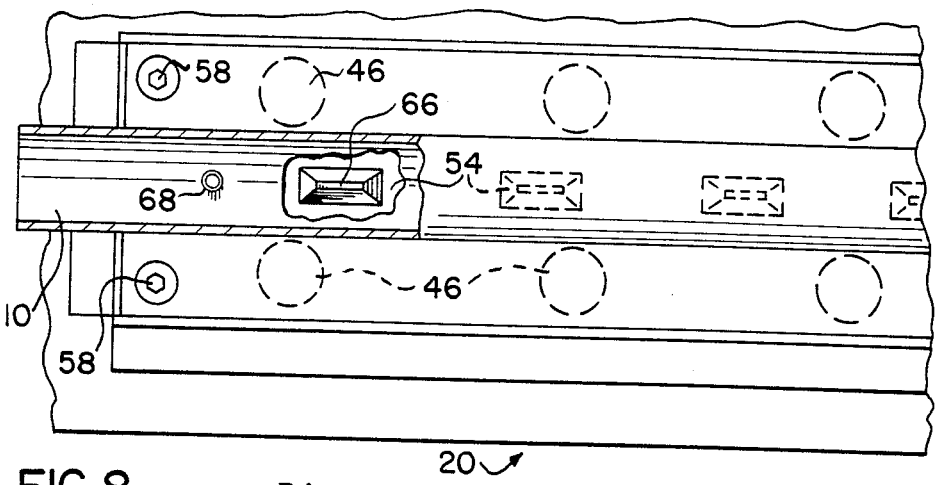
FIG. 7 is a view taken generally along line 7—7 of FIG. 6.
Figure 8:
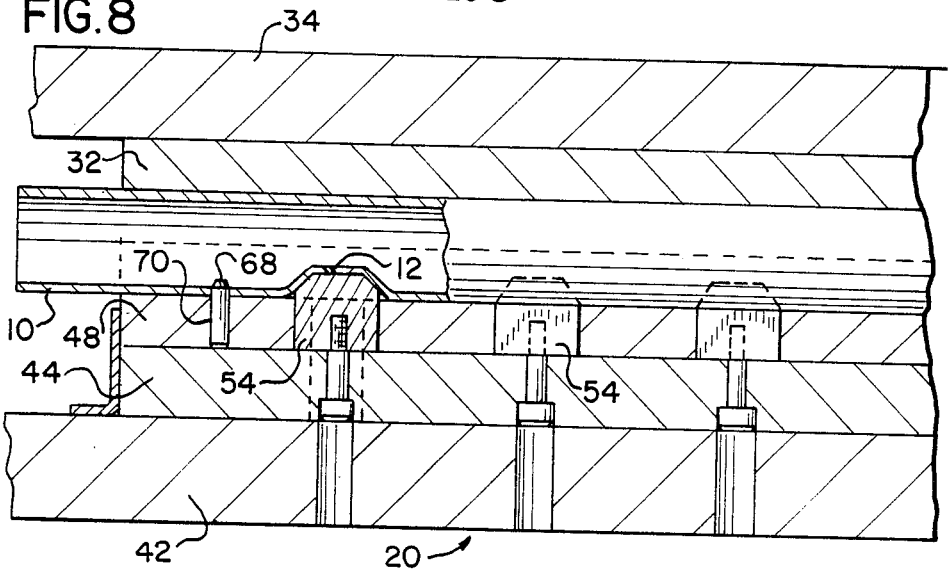
FIG. 8 is a view taken generally along line 8—8 of FIG. 6.

Additional details of apparatus 20 can be seen by reference to FIGS. 7 and 8. In order to provide a series of spray nozzles along the length of tubing 10, a series of individual wedges 54, one for each nozzle to be formed, are provided. Thus, individual depressions are formed for each hole 12 along tubing 10. As an alternative, a single elongated wedge could be used to form a single depression into tubing 10 extending substantially along its entire length. In such a case, if the depression is permitted to extend fully to the ends of tubing 10, an internal mandrel could be used as part of the forming tooling. Complete external support of tubing 10 then might not be needed.

From FIG. 7, it can be seen that springs 46 are positioned in pairs on opposite sides of the trough 50 formed within die 48. In addition, the bolts 58 for limiting upward movement of die 48 by springs 46 are disposed near the four corners of die 48. These details regarding placement of specific parts were omitted from FIGS. 4–6 for clarity.

In addition, it will be noted from FIGS. 7 and 8 that during the forming of holes 12 into tubing 10, an additional hole 68 is provided along the same line on which holes 12 are formed. When tubing 10 is placed into apparatus 20, hole 68 engages with a pin 70 secured within trough 50 of die 48. Thus, tubing 10 can be accurately positioned within die 48 so that holes 12 will be properly located above the leading edges 66 of wedges 51. After formation of tubing 10, hole 68 can be filled or plugged, or that portion of tubing 10 containing hole 68 can be cut off.

It should also be recognized that tubing 10 extends beyond punch 32 and die 48 when positioned within apparatus 20. Thus, tubing 10 can be placed into or removed from apparatus 20 by an operator or by appropriate machinery without placement of anything other than tubing 10 into the working area of apparatus 20.

Once removed from apparatus 20, forming of tubing 10 into a fluid conduit having a plurality of spray nozzles, such as might be used in a dishwashing machine, is essentially complete. It may be necessary to trim the ends of tubing 10 to achieve the proper length for the fluid conduit, and/or end fittings or threaded portions may be welded onto the ends of the tubing to facilitate installment of the conduit into a dishwashing machine or other apparatus in which it is to be used. While such steps may be necessary to facilitate installation of the conduit, it is to be understood that such additional steps are not regarded as forming a part of the method of the present invention.

Figures 9, 10, 11, 12:
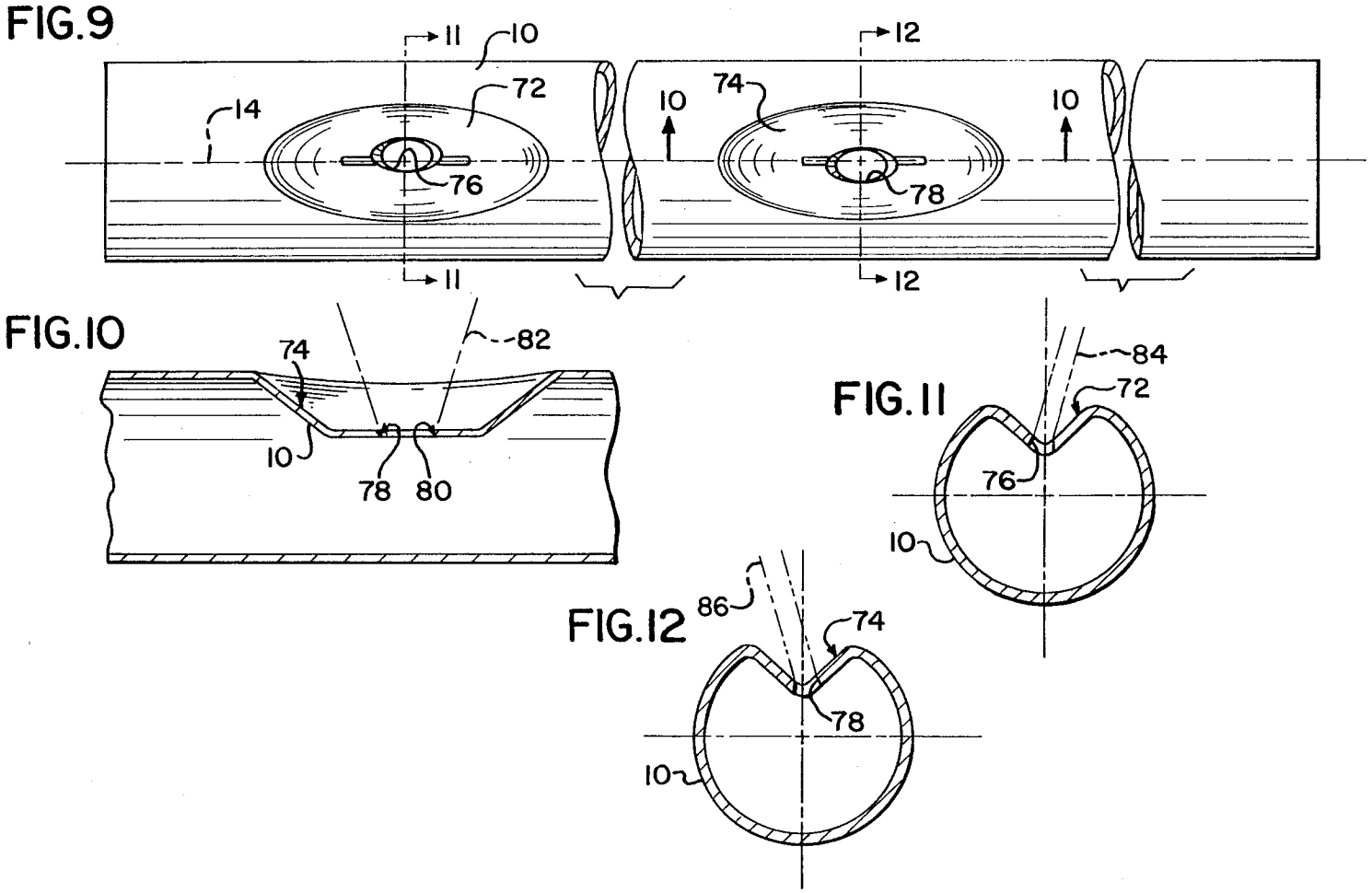
FIG. 9 is a plan view of a portion of the tuoing following complete formation into a wash arm.
FIG. 10 is a view taken generally along line 10—10 of FIG. 9.
FIG. 11 a view taken generally along line 11—11 of FIG. 9.
FIG. 12 is a view taken generally along line 12—12 of FIG. 9.

The completed fluid conduit can be seen by reference to FIG. 9. A series of depressions 72 and 74 are formed into tubing 10, with a hole 76 and 78, respectively, positioned at the center and bottom of each depression 72 and 74.

Referring to FIG. 10, it can be seen that along the direction parallel to the central tube axis, the edges 80 of hole 76 retain the bevel 80 provided by the countersinking step. Consequently, it has been found that when the fluid conduit is supplied with a liquid under pressure, a water jet emerges from each hole 76 and 78 that is fan shaped along the direction parallel to the tube axis. This can be seen as spray pattern 82 indicated in FIG. 10.

Along the direction transverse to the central tube axis, however, as seen in FIGS. 11 and 12, the stretching of the metal of tubing 10 in forming depressions 72 and 74 results in edges for holes 76 and 78 that no longer possess an outward bevel with respect to fluid flow. Therefore, water jets formed by the nozzles after the conduit has been placed in use are substantially flat in the direction transverse to the central tube axis. These flat streams are indicated as spray patterns 84 and 86. The essentially flat water streams are important for uses of the conduit where adequate coverage is critical, such as in dishwashing machines, as will be described below.

In essence, then, the inward depression of the tubing 10 during formation of the spray nozzles is carried out to a depth into the tubing that partially distorts each of the holes 76 and 78 to be of essentially equal or greater diameter on the inner surface of the tubing than on the outer surface. This distortion occurs, however, only at right angles to the imaginary line 14 along which the holes were formed, so that along line 14, each hole continues to be of greater diameter on the outer tubing surface. This directional distortion results in the finished nozzles producing the spray patterns described above.

An important additional feature of the present invention can be seen by reference back to FIGS. 2, 9, 11 and 12. From FIGS. 2 and 9, it will be noted by careful observation of these figures that while holes 12 (or holes 76 and 78) are provided substantially along line 14, the holes are in fact staggered in alternating fashion slightly to either side of line 14. In the preferred embodiment, such offset is of essentially uniform degree in either direction from imaginary center line 14, and is of a magnitude of 0.02 to 0.05 cm. The offset is not sufficient to affect either formation of the spray nozzles or the fan shape of the water streams produced thereby. However, as seen in FIGS. 11 and 12, holes 76 and 78 are slightly shifted with respect to the bottom-most portion of depressions 72 and 74. This results in water streams being produced that emerge from the tubing 10 at the angles shown by spray patterns 84 and 86.

Due to the offset of the holes, at distances from tubing 10 at which the water streams have fanned to a width greater than the separation of adjacent holes, the streams will nonetheless be able to essentially overlap without any interference therebetween. It can thus been seen that the specific amount of offset is a function of the relative separation between adjacent holes and the width of the fans produced thereby.

Spray nozzles formed by the method of the present invention can therefore be provided sufficiently close together to insure adequate spray coverage, without any interference with the velocity or direction of the water stream emerging from each nozzle. In a dishwasher, this results in effectively a solid, relatively thin wall of water being directed from the tubing 10 to the ware.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention which is defined in the appended claims.

What is claimed is:

1. A method of forming a spray nozzle along a fluid conduit comprising the steps of:

forming a hole into a length of ductile tubing having an inner surface, an outer surface, and a central tube axis, said hole defining an opening having an axis substantially radial to said central tube axis;

providing a countersink for said hole whereby said opening is of greater diameter on said outer surface of said tubing than on said inner surface; and depressing inwardly a portion of said tubing along a line parallel to said central tube axis extending along said outer surface of said tubing and passing over said hole.

2. The method as defined in claim 1, comprising the further step of subsequent to providing said countersink, supporting said tubing around substantially the entire portion of said outer surface, and wherein said depressing inwardly of said tubing is performed by:

positioning against said outer surface of said tubing a wedge having a leading edge, said edge being disposed against said outer surface along said line and directed toward said central tube axis; and forcing said wedge radially against said tubing, whereby said outer surface along said line is moved toward said central tube axis.

3. A fluid conduit having a spray nozzle formed therein by the method defined in claim 1, wherein said hole is formed as a circular hole, whereby the spray nozzle defines an oval spray opening on said outer surface of said tubing having a greater dimension parallel to said central tube axis, and wherein said inwardly depressed portion of said tubing defines an elongated depression having an axis parallel to said centeral tube axis and a pair of opposed, generally planar side walls.

4. A method of forming a plurality of spray nozzles along a fluid conduit comprising the steps of:

drilling a plurality of holes into a length of ductile tubing having an inner surface, an outer surface, and a central tube axis, said holes defining an opening having an axis substantially radial to said central tube axis and being drilled along a line parallel to said central tube axis extending along said outer surface;

providing a countersink for each of said holes whereby said openings are of greater diameter on said outer surface of said tubing than on said inner surface; and depressing inwardly at least a portion of said tubing along said line including each segment thereof passing over any of said holes, said depressing being carried out to a depth which distorts each of said holes to be of essentially equal or greater diameter on said inner surface at right angles to said line, thereby forming a spray nozzle at each of said holes that provides a spray pattern, when said tubing is under liquid pressure, that defines a fan parallel to said central tube axis and that is of relative flat narrow width at right angles to said fan.

5. The method as defined in claim 4, wherein the depressing inwardly of said tubing forms a plurality of depressions along said line, one of said depressions being formed about each of said holes.

6. The method as defined in claim 4, wherein the depressing inwardly of said tubing forms a single depression along said line, said depression being formed to extend across all of said holes.

7. The method as defined in claim 4, comprising the further step of following the drilling and providing a countersink for each of said holes, deburring each of said holes.

8. The method as defined in claim 4, comprising the further step of subsequent to providing said countersink for each of said holes, supporting said tubing around substantially the entire portion of said outer surface, and wherein said depressing inwardly of said tubing is performed by:

positioning against said outer surface of said tubing at least one wedge having a leading edge, said edge being disposed against said outer surface along said line and directed toward said central tube axis; and forcing said wedge radially against said tubing, whereby said outer surface along said line is moved toward said central tube axis.

9. The method as defined in claim 4, wherein said holes are drilled along said line but off-center therefrom such that when said tubing is under liquid pressure, said spray patterns are formed non-radially from said tubing.

10. The method as defined in claim 9, wherein said holes are drilled off-center to either side of said line in alternating but uniform fashion.

11. A fluid conduit having a plurality of spray nozzles formed therein by the method defined in claim 4, wherein said holes are formed as circular holes, whereby the spray nozzles define a plurality of oval spray openings on said outer surface of said tubing with each having a greater dimension parallel to said central tube axis, and wherein said inwardly depressed portions of said tubing define a plurality of elongated depressions, with each of said depressions having an axis parallel to said centeral tube axis and a pair of opposed, generally planar side walls.

12. A fluid conduit having a plurality of spray nozzles formed therein by the method defined in claim 4, wherein said holes are drilled along said line but off-center to either side of said line in alternating uniform fashion.

13. A fluid conduit having a plurality of spray nozzles formed therein by the method defined in claim 4, wherein said tubing is formed from stainless steel.

14. Apparatus for forming a spray nozzle into a length of ductile cylindrical tubing, said tubing having an inner surface, an outer surface and a central tube axis, and defining a hole therethrough substantially radial to said central tube axis, said hole being provided with a countersink whereby said hole is of greater diameter on said outer surface than on said inner surface, said apparatus comprising:

means for releasably supporting said tubing around substantially the entire portion of said outer surface;

a wedge having a leading edge slidably carried within an opening through said supporting means for positioning of said leading edge against said outer surface of said tubing when held within said supporting means, said wedge being disposed adjacent said outer surface to extend axially of said tubing and across said hole; and means for causing relative movement of said wedge with respect to said supporting means inwardly against said tubing for depressing inwardly the portion thereof adjacent said wedge to a depth which distorts said hole to be of essentially equal or greater diameter on the inner surface at right angles to said leading edge, thereby forming a spray nozzle that provides a spray pattern, when said tubing is under liquid pressure, that defines a fan parallel to said central tube axis and that is of relative flat narrow width at right angles to said fan.

15. Apparatus as defined in claim 14, wherein said releasable supporting means includes a punch and a cooperation die, said die having a first semi-cylindrical trough defined therein of a diameter equal to the diameter of said tubing, and said punch having a second semi-cylindrical trough therein of a diameter equal to the diameter of the said tubing, said first and second troughs cooperating to firmly support the outer surface of said tubing during depression of said tubing by said wedge.

16. Apparatus as defined in claim 15, wherein said opening defined through said supporting means is defined through said die.

17. Apparatus as defined in claim 16, further comprising means for locating said tubing within said second trough such that said hole is positioned over said opening to cause said leading edge of said wedge to contact said tubing across said hole.

18. Apparatus for forming a spray nozzle into a length of ductile cylindrical tubing, said tubing having an inner surface, an outer surface and a central tube axis, and defining a hole therethrough substantially radial to said central tube axis, said hole being provided with a countersink whereby said hole is of greater diameter on said outer surface than on said inner surface, said apparatus comprising:

means for releasably supporting said tubing around substantially the entire portion of said outer surface;

a wedge having a leading edge slidably carried within an opening through said supporting means for positioning of said leading edge against said outer surface of said tubing when held within said supporting means, said wedge being disposed adjacent said outer surface to extend axially of said tubing and across said hole; and means for causing relative movemnt of said wedge with respect to said supporting means inwardly against said tubing for depressing inwardly the portion thereof adjacent said wedge to a depth which distorts said hole to be of essentially equal or greater diameter on the inner surface at right angles to said leading edge, thereby forming a spray nozzle that provides a spray pattern, when said tubing is under liquid pressure, that defines a fan parallel to said central tube axis and that is of relative flat narrow width at right angles to said fan;

said releasable supporting means including a punch and a cooperating die, said die having a first semi-cylindrical trough defined therein of a diameter equal to the diameter of said tubing, and said punch having a second semi-cylindrical trough therein of a diameter equal to the diameter of the said tubing, said first and second troughs cooperating to firmly support the outer surface of said tubing during depression of said tubing by said wedge;

said opening defined through said supporting means being defined through said die;

and wherein said means for causing relative movement of said wedge includes:

means for fixedly mounting said wedge;

means for movably supporting said die over said fixed mounting means such that said wedge is normally disposed within said opening but outside of said second trough;

means for movably supporting said punch over said die;

ram means for selectively moving said punch downwardly into contact with said die, and thereafter, moving said punch and said die downwardly toward said fixed mounting means, whereby said wedge is moved into said second trough; and means for biasing said die in an upward direction such that upon withdrawing said punch from said die by upward movement of said ram means, said die is moved upwardly from said mounting means, whereby said wedge is moved out of said second trough.

* * * * *